US005183108A

United States Patent [19]

Lee, Jr. et al.

[11] Patent Number: 5,183,108

[45] Date of Patent: Feb. 2, 1993

[54] INFLATABLE PACKER

[75] Inventors: Albert H. Lee, Jr.; Carl H. Sabo, both of Wichita Falls, Tex.

[73] Assignee: The Gates Rubber Company, Denver, Colo.

[21] Appl. No.: 747,042

[22] Filed: Aug. 19, 1991

[51] Int. Cl.[5] ..... E21B 33/127; F16J 15/46

[52] U.S. Cl. ..... 166/187; 277/9; 277/34; 277/230

[58] Field of Search ..... 166/187, 122; 277/34, 277/34.6, 230, 9

[56] References Cited

U.S. PATENT DOCUMENTS

| | | | |
|---|---|---|---|
| 2,643,722 | 6/1953 | Lynes et al. | 166/187 X |
| 2,778,432 | 1/1957 | Allen | 166/187 |
| 3,542,127 | 11/1970 | Malone | 166/187 X |
| 4,372,562 | 2/1983 | Carter, Jr. | 166/187 X |
| 4,617,346 | 9/1986 | Ito | 166/187 X |
| 4,886,117 | 12/1989 | Patel | 166/187 |

*Primary Examiner*—Stephen J. Novosad

*Attorney, Agent, or Firm*—J. L. Isaac; S. Austin; C. H. Castleman, Jr.

[57] ABSTRACT

An inflatable packer includes an elastomeric tubular body and an outer cover surrounding the body. An end member is also provided having a capped portion threadably engageable with an annular ring member, the ring member being secured to the end portion of the outer cover. A plurality of reinforcing elements are sandwiched between the cover and the body and have end portions terminating beneath the ring member. Finally, there is a mechanism for wedging the end portion of the reinforcing elements against the inner surface of the ring member in response to increased threaded engagement between the capped portion and the ring member to retain the elements in position beneath the ring member.

34 Claims, 3 Drawing Sheets

INFLATABLE PACKER

BACKGROUND OF THE INVENTION

1. Field of the Invention

The present invention relates generally to an inflatable packer attached to a supporting element for sealing an annular space in a well bore and, more particularly, to an improved inflatable packer for use in high temperature environments. Specifically, the present invention relates to improved inflatable packers having high pressure resistance to prevent blow outs under high temperature and pressure situations.

2. Description of the Prior Art

Inflatable packers are down-holed tools useful in the well drilling industry as well as in other piping applications. An inflatable packer is internally inflatable utilizing a fluid for the purpose of sealing off an annular space in the well or pipe, for example between the casing and the well bore, or between a drill string or other retrievable tool and an outer well casing. Although not so limited, the packer of the present invention is particularly suited for isolating zones within a well for such purposes as cementing, fracturing, treating, testing, preventing gas migration to the surface, and for gravel pack operations.

Inflatable packers normally include an elastomeric body and a reinforcement sheath or layer. A recognized problem with prior art packers has been the inability to securely anchor the reinforcing elements of the packer body to end sleeve members or ferrules which couple the packer assembly to the casing, drill string or other down-hole tool. Typically, the reinforcing elements have been clamped at their ends and, in some instances, the mechanical clamping has occurred through the use of epoxy adhesives along the interface between the reinforcement element free ends and a portion of the sleeve termination to provide both adhesive connection as well as a potential wedging connection. Other problems in practice include the tendency of the body of the packer to rupture or develop pinhole leaks and the failure of the body to return substantially to its original uninflated configuration after repeated inflation/deflation cycles. Examples of such prior art devices include those disclosed in U.S. Pat. Nos. 2,643,722, 2,872,230, 2,970,651, 3,028,915, 3,035,639, 4,191,383, 4,700,954 and Canadian Patent No. 702,327.

A recent attempt to provide a packer construction which overcomes the aforementioned problems while also withstanding high internal inflation pressures and external differential pressures across the packer elements is disclosed in U.S. Pat. No. 4,614,346, issued Sep. 30, 1986, and assigned to the assignee of the present invention, the contents of which are specifically incorporated herein by reference. Unfortunately, while such inflatable packer constructions are quite adequate in many applications, high temperature applications encountered in the instances of deep well drilling have caused some unique problems. In inflatable packer devices utilizing epoxy based resins or other adhesive materials to anchor the ends of the reinforcement to the end sleeve of the packer assembly, either through adhesive or wedging capabilities, the packers tend to loose their adhesive and anchoring capability at such high temperatures due to the softening of the epoxy resin material. In such instances, the ends of the packers tend to rupture upon inflation due to the pulling out or removal of the reinforcement members resulting from softening of the anchoring material. Therefore, there remains a need for an inflatable packer construction wherein the reinforcement sheath or elements are capable of being anchored and remain anchored even during repeated high temperature applications.

SUMMARY OF THE INVENTION

Accordingly, it is one object of the present invention to provide an improved inflatable packer useful under high temperature environment situations.

It is another object of the present invention to provide an inflatable packer with an improved anchoring mechanism for reinforcing elements of the packer body to the end sleeve or ferrule members.

Yet another object of the present invention is to provide an improved inflatable packer capable of withstanding high internal inflation pressures and external differential pressures across the packer element.

To achieve the foregoing and other objects and in accordance with a purpose of the present invention as embodied and broadly described herein, an inflatable packer is disclosed and includes an elastomeric tubular body surrounded by an outer cover. An end member is provided having a cap portion threadably engageable with an annular ring member, the ring member being secured to the terminal end of the outer cover. A plurality of reinforcement elements are provided sandwiched between the cover and the tubular body and having end portions terminating beneath the ring member. A mechanism is provided for wedging the ends of the reinforcing elements against the inner surface of the ring member to retain the elements in position beneath the ring member. Finally, a device may be secured to the end of the tubular body and is adapted for sliding movement relative to the end member in response to movement of the tubular body upon inflation of the packer to relieve stress between the tubular body and the end member.

BRIEF DESCRIPTION OF THE DRAWINGS

The accompanying drawings, which are incorporated in and formed part of the specification, illustrate preferred embodiments of the present invention and together with a description, serve to explain the principles of the invention. In the drawings.

DETAILED DESCRIPTION OF THE PREFERRED EMBODIMENTS

Figure 1:
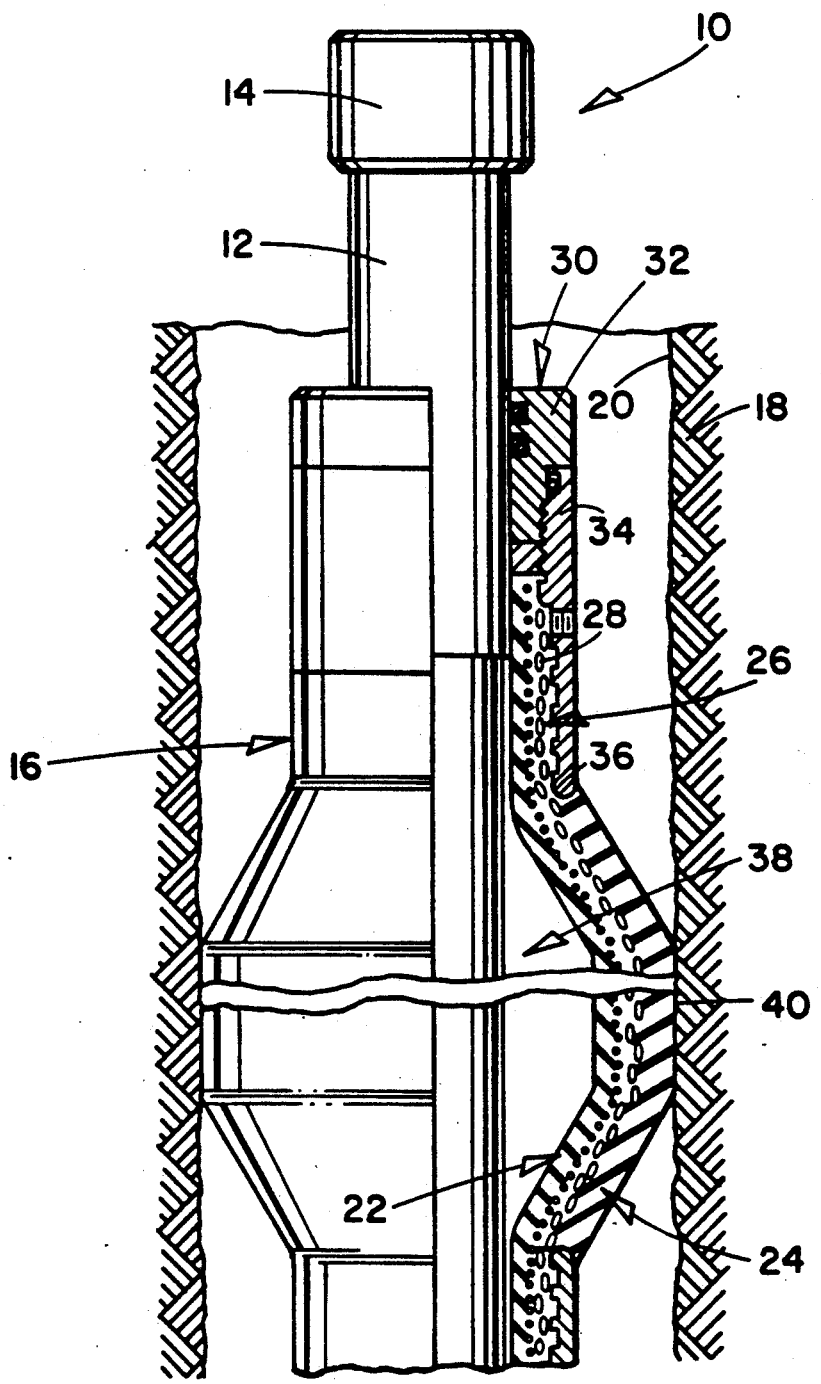
FIG. 1 is a vertical sectional view, partially broken away, of a typical inflatable packer and tool assembly shown inflated against a well bore.

Referring first to FIG. 1, a typical inflatable packer device 10 is illustrated. The packer assembly 10 includes an inner cylindrical mandrel 12 connected to a casing string 14 with the inflatable annular packer element 16 supported on the mandrel 12. Although this particular embodiment describes a casing type packer to seal against the well bore 18 having an inner bore surface 20 of a subterranean formation, the packer 16 can alternatively be installed on a drill string, corresponding to the mandrel 12, located inside of a well casing for sealing the annular space therebetween.

In general, the packer element 16 includes an elastomeric tubular body or core 22, an outer cover 24 preferably made from an abrasion resistant elastomeric material, and an annular reinforcement sheath or layer 26 composed of individual reinforcement elements 28. The reinforcement elements 28 are sandwiched between the tubular body or core 22 and the outer cover 24. In a typical preferred embodiment of the invention, the reinforcement sheath or layer 26 is formed from a plurality of such reinforcement elements 28 helically wound about the tubular body 22, each of the elements 28 preferably being in the form of reinforcement strands or cables as described below and as is well known to the art.

In the embodiment illustrated in FIG. 1., the packer 16 is terminated at its end by a ferrule or end member 30 which includes an end cap 32' and an annular ring or sleeve 34 which is readily engageable with the end cap 32. The annular ring or sleeve 34 is affixed to the outer cover 24 at the surface 36 by the use of any standard typical attachment means such as epoxy resin and the like. Thus, the annular sleeve 34 of the ferrule 30 represents a rigid or fixed portion of the packer 16, this arrangement being repeated on both ends of the packer 16. The central portion 38 of the packer 16 has its outer cover 24 unreinforced.

The packer illustrated in FIG. 1 is its inflated state wherein pressurized fluid is injected into the central portion 38 to expand the central portion 38 so that the outer surface 40 of the outer cover 24 is expanded and contacts the surface 20 of the well bore 18 and thus maintains the packer 16 in position within the well bore 18. To remove the packer 16 from the well bore 18, the pressurized fluid is removed from the central zone 38 so that the tubular body 22 and outer cover 24 deflate to their original position in vertical alignment with the ferrule 30.

A major problem with previous packer designs is that the inflation and deflation of the central zone 38 to engage the surface 20 of the well bore 18 causes extreme and repeated pressures and forces at the juncture between the tubular body 22, the outer cover 24 and the ferrule 30. These forces also act on the anchoring mechanism of the reinforcement elements 28 at their terminal portions proximate the ferrule 30. Excessive pressure within the zone 38 can increase the forces at this anchoring juncture to the point where the tubular body 28 and/or outer cover 24 ruptures, or where the reinforcement elements 28 are pulled away from their anchoring position thereby rupturing this juncture between the ferrule 30 and the body 22 and cover 24. The present invention is designed to overcome these aforementioned problems.

Figure 2:
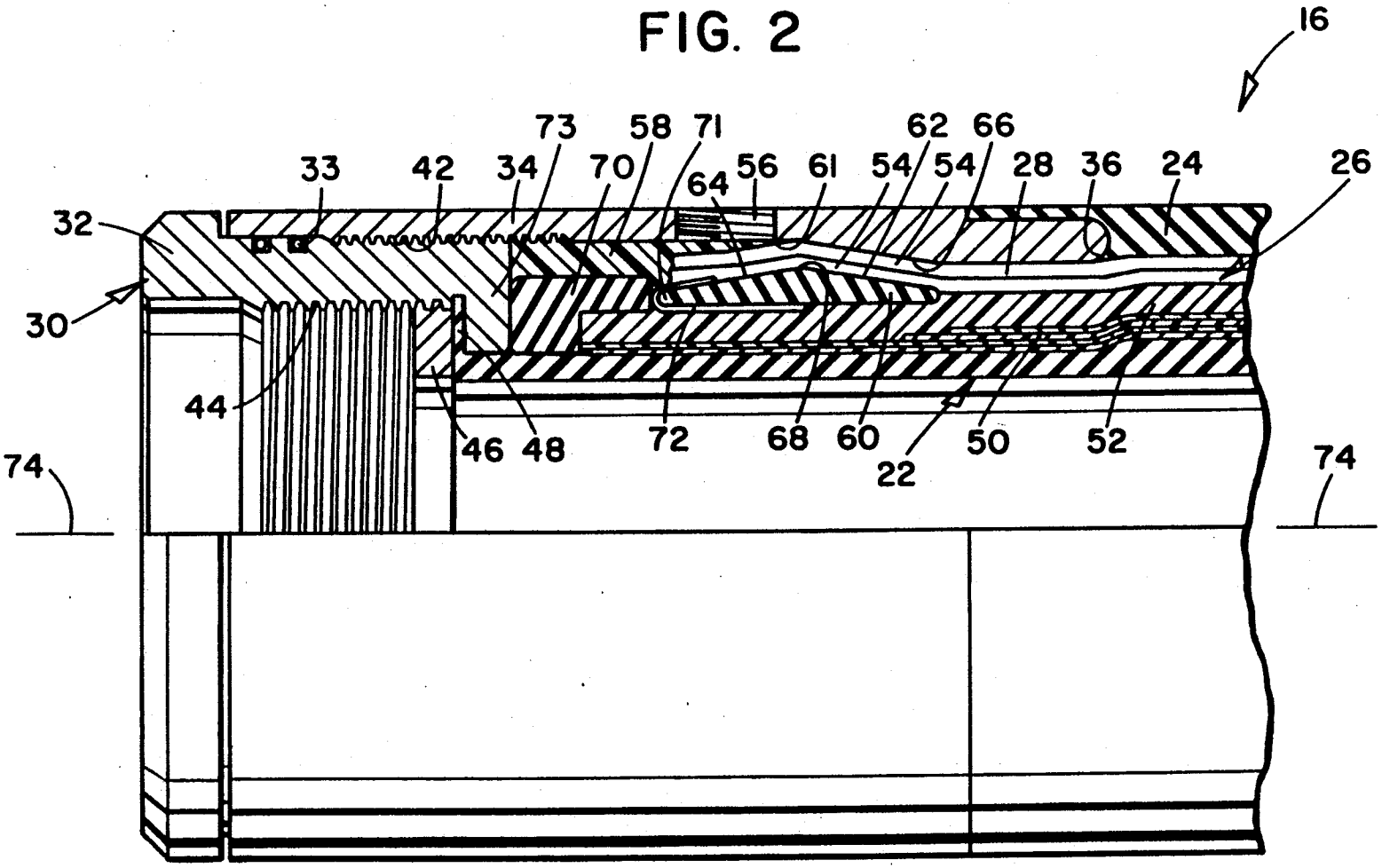
FIG. 2 is an enlarged, partially sectional view of the detailed construction of the packer body end termination portion illustrating one embodiment of the present invention.

Referring to FIG. 2, there is illustrated herein the end portion of a packer 16 showing one embodiment of the present invention. Throughout this specification, like numbers designate like parts between the various Figs. In this particular embodiment, the end member or ferrule 30 includes the cap portion 32 which is preferably threadably engageable through the threads 42 with its annular ring member or portion 34. The tubular body 22, which is preferably made of an elastomeric rubber, is terminated at the axially inner surface of the end cap 32 which includes threads 44. To assist in termination as well as preventing fluid elements from entering the packer, an annular seal ring 46 is provided at the very end portion 48 of the tube 22, the sealing ring 46 being threadably engaged with the threads 44 on the inner surface of the cap 32. In the illustrated embodiment, the elastomeric tubular body 22 also preferably includes restricter belts 50 which can be made up of aramid fiber and the like, as well as an elastomeric carcass 52 which can be made from any elastomeric-type material but preferably from an aramid. The reinforcing elements 28 run lengthwise along the outer surface of the tube 22 between the tube 22 and the outer cover 24 as illustrated. The reinforcement elements 28 include terminal end portions 54 which preferably lie between the tubular member 22 and the rigid annular ring member 34. In prior embodiments, the terminal end portions 54 were retained in position by epoxy resin and the like which acted to adhesively connect the terminal ends 54 to the ring 34 as well as creating a wedging effect after solidification thereof, an opening 56 being typically provided for permitting the introduction of epoxy resin as described.

In this particular embodiment, the opening 56 is likewise used for introducing an epoxy resin 58 into the end portion of the packer 16, although the epoxy resin 58 functions in a somewhat different manner than in prior embodiments. In this particular embodiment, a mechanism for mechanically wedging the terminal ends 54 against the inner surface of the ring 34 is provided in the form of a wedge-shaped member 60 which preferably is in the form of an annular ring fitted about the distal end of the tubular body 22. This annular ring 60 is sized, shaped and oriented in order to pinch reinforcement the end portions 54 against the inner surface 61 of the ring 34 when the end cap 32 is threadably engaged with the ferrule ring 34. To assist in this wedging or pinching mechanism, the wedge ring 60 preferably includes a circumferential surface in the form of at least one tapered wedge face 62 and preferably a second tapered wedge face 64 which is tapered oppositely away from the face 62 so as to form a substantially inverted "V"-shaped cross-section as illustrated in FIG. 2.

In order to assist in the wedging leverage action of the wedge 60, the inner surface of the ring 34 preferably includes a sloped surface 66 oriented at an angle substantially the same as the angle of the wedge surface 62 so that the wedge surface 62 is preferably substantially parallel to the slope surface 66. In the preferred embodiment, the juncture of the two wedge faces 62, 64 forms a peak 68 which, in preferred form, has an angle of approximately 190 degrees from face 62 to face 64. As is illustrated, the wedge face 62 forces the reinforcement end portions 54 up against the sloped surface 66. Upon introduction of the adhesive 68 through opening 56, the adhesive, preferably epoxy, adhesively connects the wedge ring 60 with the end portions 54 and the ring 34 so as to solidify the position of the end portions 54. Thus, when the end cap 32 is tightened within the packer 16, the peak 68 pinches the end portions 54 against the inner surface of the ring 34. To assist in this action, a spacer 70 is interposed between the distal end 71 of the wedge 60 and the axially inner end 73 of the end cap 32. Thus, the greater the threaded engagement between the end cap 32 and the ring member 34, the greater the pressure of this spacer 70 against the wedge ring 60, thereby increasing the force between the wedge ring 60 and the reinforcement end portions 54.

To further assist in maintaining the position of the wedge ring 60, an additional restricter belt 72 is provided wrapped around the distal end 73 of the wedge ring 60 so as to help in the use of the epoxy 58 to firmly attach and secure the wedge 60 to the inner tube 22.

In operation, as the packer 16 is assembled and the end cap 32 threadably engaged with the ring 34, pressure is exerted from the end cap 32 through the spacer 70 against the wedge 60 so as to create a force between the wedge 60 and the outer ring member 34 to pinch and wedge the end portions 54 of the reinforcing elements 28. When the packer 16 expands during inflation as illustrated in FIG. 1, there is a tendency for the reinforcement elements 28 to pull away from the ferrule 30 due to their being stretched at the central portion 38 of the packer of 16. This stretching of the reinforcing elements 28 tends to pull the reinforcing elements 28 along with the tube 22 longitudinally along the axis 74 of the packer 16. When this occurs, the wedge ring 60 is likewise urged in the axial direction of the reinforcement elements 28 and the tubular body 22, which urging action creates an even greater wedging force between the wedge ring 60 and the sloped surface 66 of the ferrule ring 34. Thus, the greater the expansion of the central area 38, the greater the force created by the wedge 60 against the end portions 54 to retain the reinforcing elements 28 in position to prevent rupture and blow out. While the wedge ring 60 is illustrated as having two oppositely tapered faces 62, 64, it is envisioned that the wedge ring 60 may function with only one such tapered face to work in conjunction with the inner surface 66 of the ferrule ring 34.

Figure 3:
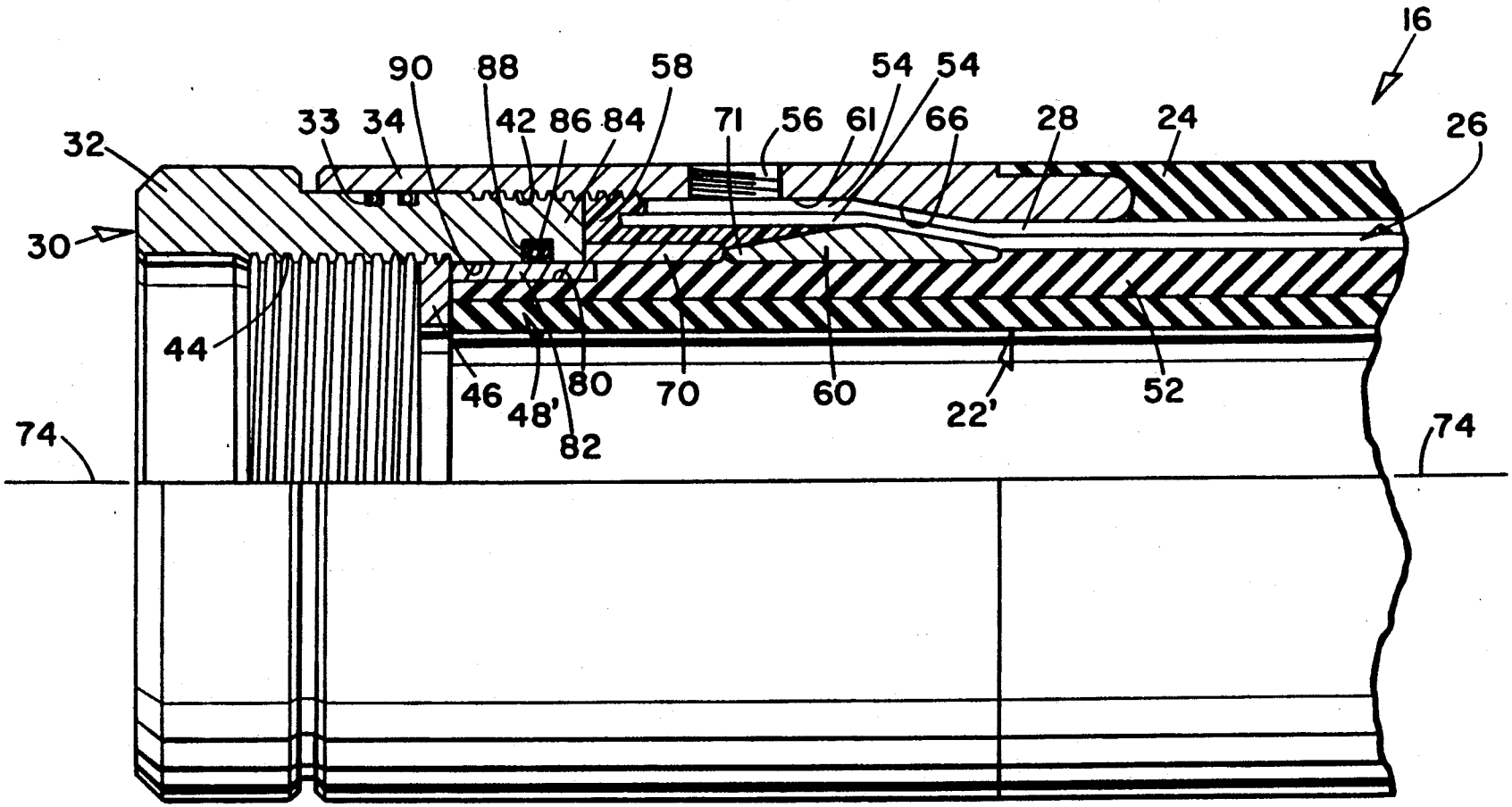
FIG. 3 is an enlarged, partially sectional view similar to that of FIG. 2 but illustrating an alternate embodiment of the invention.

Referring to FIG. 3, an alternate embodiment of the present invention is illustrated. In this particular illustrated embodiment, the wedge member 60 is shown in position creating a wedging force against the reinforcement element end portions 54. As in the previous embodiment, this wedging force is increased as the threading engagement between the ferrule cap 32 and the ferrule ring 34 increases by the action of a spacer 70. In addition to the tendency of the reinforcement elements 28 to be ripped or pulled from their fixed position within the ferrule 30, which problem is overcome with the wedge arrangement previously described, the elastomeric tubular body 22 also tends to want to move axially away from the ferrule 30 toward the central region 38 as the packer 16 is inflated. Referring to the embodiment illustrated in FIG. 2, the terminal portion 48 of the tubular body 22 is embedded and mechanically maintained in place between the spacer ring 46 and the ferrule end cap 32. This tendency of the tubular member 22 to move axially along axis 74 away from the ferrule 30 creates an exceptionally high stress at the end portion 48 of the tubular member 22. This can cause the tubular member 22 to be ruptured at this juncture thereby causing failure of the packer 16 itself. The embodiment illustrated in FIG. 3 is designed to eliminate this particular problem.

Referring again to FIG. 3, the end portion 48' of the tubular body 22' in this particular embodiment preferably has a circumferential groove 80 formed about the very end portion thereof. A sleeve or collar 82 is then positioned within this groove 80 and secured thereto by any appropriate means such as epoxy resin and the like. Thus, the annular collar 82 becomes an integral unit with the tubular body 22'. The end portion 84 of the ferrule cap 32 is preferably extended, and an appropriate sealing mechanism 86 such as an O-ring disposed within a groove 88 is provided in the inner surface 90 of the ferrule cap 32. The sealing mechanism or O-ring 86 provides a seal between the ferrule cap 32 and the collar 82 so as to prevent any material or fluid from passing into or out of the packer 16. It should be understood that the annular collar 82 is not attached to the ferrule cap 32 so that the distal end 48' of the tubular body 22' is not mechanically or chemically secured to the ferrule 30. Thus, when the tubular body 22' tends to move axially along axis 74 away from the ferrule 30 in response to inflation of the packer 16, the sleeve 82 also moves along the inner surface 90 of the ferrule cap 32 so as to substantially reduce and even eliminate the stress forces previously found at the distal end 48' of the tubular body 22'. Thus, this slight movement, which generally only amounts to ¼–⅛ in., relieves the elastomeric material of the tubular body 22' from breakage and rupturing, thereby preventing rupture of the packer 16.

As can be seen from the above, the present invention is designed to provide a substantially improved anchoring mechanism for both the reinforcing elements as well as the internal tubular body in an inflatable packer. While providing an improved anchoring mechanism, the embodiments of the present invention have substantially reduced the incidence of and chances for rupture of the inflatable packer as it is repeatedly inflated and deflated, since the continuous inflations/deflations of the packer do not affect the anchoring mechanisms of the present invention. Moreover, as the inflatable packer of the invention is used in deeper wells and subjected to much higher temperatures, the present invention is not affected by such environmental considerations, which is a significant advantage over the prior epoxy or other resin based adhesive anchoring systems. Thus, the present invention provides a much more adaptable and flexible usefulness for inflatable packers incorporating the same.

The foregoing description and the illustrative embodiments of the present invention have been shown in the drawings and described in detail in varying modifications and alternate embodiments. It should be understood, however, that the foregoing description of the invention is exemplary only, and that the scope of the invention is to be limited only to the claims as interpreted in view of the prior art. Moreover, the invention illustratively disclosed herein suitably may be practiced in the absence of any elmont which is not specifically disclosed herein.

The embodiments for which an exclusive property or privilege is claimed are defined as follows:

1. An inflatable packer comprising:
an elastomeric tubular body;
an outer cover surrounding said body;
an end member having a cap portion threadably engageable with an annular ring member, said ring member being secured to the end portion of a said outer cover;
a plurality of reinforcing elements sandwiched between said cover and said body and having end portions terminating beneath said ring member; and
means for wedging the end portions of said reinforcing elements against the inner surface of said ring member in response to increased threaded engagement between said cap portion and said ring member to retain said elements in position beneath said ring member.

2. The packer as claimed in claim 1, wherein said wedging means is adapted to increase the wedging force against said reinforcing elements in response to increased internal pressure during packer inflation.

3. The packer as claimed in claim 1, wherein said packer further includes a spacer member disposed between said cap portion and said wedging means to increase the wedging force against said reinforcement elements by said wedging means in response to increased threaded engagement between said cap portion and said ring member.

4. The inflatable packer as claimed in claim 1, wherein said packer further includes adhesive means interconnecting said end member, said reinforcing elements and said wedging means for added attachment between said reinforcement elements and said ring member.

5. The packer as claimed in claim 4, wherein said adhesive means comprises an epoxy-based resin disposed and solidified within said packer so as to also enhance the wedging between said reinforcement elements and said ring member.

6. The packer as claimed in claim 1, wherein said wedging means comprises a wedge-shaped member interposed between said tubular body and said reinforcing element end portions and oriented to pinch said reinforcing element end portions against said ring member inner surface.

7. The packer as claimed in claim 6, wherein said ring member inner surface comprises a sloped portion relative to the axis of said tubular body to enhance the wedging action of said wedge member in response to increased internal pressure within said packer upon inflation thereof.

8. The packer as claimed in claim 6, wherein said wedge member comprises an annular member with an outer circumferential surface having at least one tapered, wedge-shaped annular face thereon.

9. The packer as claimed in claim 8, wherein said outer circumferential surface includes a pair of tapered, wedge-shaped faces oppositely disposed thereon, said annular member having a substantially inverted V-shaped cross-section.

10. In an inflatable packer having an elastomeric tubular body, an outer elastomeric cover surrounding said body, a ferrule having an end portion engageable with an annular ring portion, a plurality of reinforcing elements having end portions disposed between said ferrule ring portion and said tubular body, and means for securing said reinforcing element end portions in position between said ferrule ring portion and sad tubular body during inflation of said packer, the improvement wherein said reinforcement element securing means comprises means for mechanically wedging the ends of said reinforcing elements against the inner surface of said ferrule annular ring portion in response to increased engagement between said ferrule end portion and said ferrule annular ring portion.

11. The improvement of claim 10, wherein said reinforcement element securing means further comprises adhesive means interconnecting said ferrule, said reinforcing element end portions and said wedging means for increasing the attachment between said reinforcement end portions and said ferrule annular ring portion.

12. The improvement of claim 10, wherein said mechanical wedging means comprises a wedge-shaped member interposed between said tubular body and said reinforcement element end portions and oriented to pinch said reinforcing element end portions against the inner surface of said ferrule annular ring portion.

13. The improvement of claim 12, wherein the inner surface of said ferrule ring portion includes a sloped surface relative to the axis of said tube for interaction with said wedge-shaped member to enhance the wedging action of said wedged-shaped member in response to increased internal pressure within said packer.

14. The improvement of claim 12, wherein said wedge-shaped member comprises an annular ring having a wedge-shaped circumferential surface for action against said reinforcement element end portions to create a wedging force against said reinforcement element end portions evenly distributed along the circumference said wedge-shaped ring.

15. The improvement of claim 14, wherein said wedge-shaped ring circumferential surface includes a pair of tapered, wedge-shaped faces oppositely disposed thereon, said wedge-shaped ring member having a substantially inverted V-shaped cross-section.

16. The improvement of claim 15, wherein said securing means further includes adhesive means interconnecting said ferrule, said reinforcement element end portions and said wedge-shaped ring.

17. The improvement of claim 15, wherein said securing means further includes adhesive means interconnecting the distal end portion of said reinforcement elements with said ferrule annular ring portion.

18. The improvement of claim 12, wherein said improvement further comprises a spacer ring disposed between said ferrule end portion and said wedging means to enhance the wedging force between said wedge means and said reinforcement elements upon increasing the engagement between the ferrule end portion and said ferrule annular ring portion.

19. An inflatable packer comprising:

an elastomeric tubular body;

an outer cover surrounding said body;

an end member having a cap portion threadably engageable with an annular ring member, said ring member being secured to the terminal end of said outer cover;

a plurality of reinforcing elements sandwiched between said cover and said tubular body and having end portions terminating beneath said ring member; and means secured to the end of said tubular body and adapted for sliding movement relative to said end member in response to movement of said tubular body upon inflation of said packer to relieve stress between said tubular body and said end member.

20. The packer as claimed in claim 19, wherein said means for sliding movement comprises an annular collar secured to the distal end of said tubular body proximate said end member.

21. The packer as claimed in claim 20, wherein said annular collar is secured about the outer end surface of said tubular body for sliding movement with said tubular body relative to the inner annular surface of said end member cap portion.

22. The packer as claimed in claim 21, wherein said means for sliding movement further comprises means for sealing between said collar and said end portion.

23. The packer as claimed in claim 22, wherein said sealing means comprises an O-ring interposed between said collar and the inner surface of said end portion to prevent foreign elements from entering the internal portion of said tube.

24. The packer as claimed in claim 19, wherein said tubular body is free from attachment to said end member, and wherein said means for sliding movement comprises an annular sleeve secured about the distal end of said tubular body proximate said end member to permit axial movement of said tubular body relative to said end member to reduce the stretching of said tubular body beyond the composition limits thereof at said end member in response to inflation of said packer.

25. The packer as claimed in claim 24, wherein said means for sliding movement further comprises means for sealing between said sleeve and said end member to prevent foreign elements from entering the internal portion of said tubular body.

26. The packer as claimed in claim 24, wherein said end member comprises a ferrule.

27. The packer as claimed in claim 19, wherein said packer further includes means for wedging the end portions of said reinforcing elements against the inner surface of said ring member to retain said elements in position beneath said ring member.

28. The packer as claimed in claim 27 wherein said wedging means comprises a wedge-shaped member interposed between said tubular body and said reinforcing element end portions and oriented to pinch said element end portions against the inner surface of said annular member.

29. The packer as claimed in claim 28 wherein the inner surface of said ring member comprises a sloped face for enhancing the wedging action between said wedge-shaped member and said reinforcing element end portions in response to increased internal pressure within said packer.

30. The packer as claimed in claim 28, wherein said wedged-shaped member comprises an annular member with an outer circumferential surface having at least one tapered, wedge-shaped annular face thereon.

31. The packer as claimed in claim 30, wherein said outer circumferential surface of said annular ring includes a pair of tapered wedge-shaped faces oppositely disposed thereon, said annular member having an inverted V-shaped cross-section.

32. The packer as claimed in claim 30, wherein said packer further includes adhesive means interconnecting said reinforcing element end portions, said wedge means and said end member for added attachment between said reinforcing element end portions and said ring member.

33. The packer as claimed in claim 32, wherein said adhesive means comprises an epoxy based resin disposed to further enhance mechanical wedging in its solidified form.

34. In an inflatable packer having an elastomeric tubular body, an outer elastomeric cover surrounding said body, a ferrule having an end portion engageable with an annular ring portion, a plurality reinforcing elements having end portions disposed between said ring portion and said body, and means for securing said reinforcement element end portions in position between said ring portion and said body during inflation of said packer, the improvement comprising means secured to the terminal end of said tubular body and adapted for sliding movement relative to said ferrule in response to movement of said tubular body upon inflation of said packer to relieve stress between said tubular body and said ferrule.

* * * * *

UNITED STATES PATENT AND TRADEMARK OFFICE

CERTIFICATE OF CORRECTION

PATENT NO. : 5,183,108

DATED : Feb. 2, 1993

INVENTOR(S) : Albert H. Lee, Jr.; Carl H. Sabo

It is certified that error appears in the above-identified patent and that said Letters Patent is hereby corrected as shown below:

Column 7, Claim 10, line 47: delete "sad" and substitute therefor "said".

Signed and Sealed this

Ninth Day of November, 1993

Bruce Lehman

*Attest:*

BRUCE LEHMAN

*Attesting Officer*

*Commissioner of Patents and Trademarks*